United States Patent [19]

Downing

[11] 3,960,464

[45] June 1, 1976

[54] IMPROVEMENTS IN AND RELATING TO FANS

[75] Inventor: John Kenneth Downing, Cuckfield, England

[73] Assignee: Vent Axia Limited, Crawley, England

[22] Filed: Mar. 25, 1975

[21] Appl. No.: 561,983

[52] U.S. Cl. ..... 415/146; 98/116; 415/151; 415/147

[51] Int. Cl.[2] ..... F01D 17/06

[58] Field of Search ..... 415/146, 159, 151, 147; 98/116

[56] References Cited

UNITED STATES PATENTS 2,812,896 11/1957 Sieradzki ..... 98/116

*Primary Examiner*—Henry F. Raduazo
*Attorney, Agent, or Firm*—Kemon, Palmer & Estabrook

[57] ABSTRACT

This invention relates to a ventilating fan of the kind comprising a housing defining an air passage, and an impeller rotatable from an electric motor or other prime mover within the housing.

The invention is concerned with the provision of an improved automatic shutter device which consists of shutter plates which may have their pivot axes tangential to a common circle and movable between a position which closes the air passage and a position which opens said air passage. The shutter device is operated by means responsive to rotation of the impeller shaft for moving the shutter means to the open position when the impeller is rotating and to the closed position when the impeller is not rotating. The shutter operating means may be such that substantially no thrust or load is placed upon the prime mover when it is rotating at a selected operating speed.

4 Claims, 3 Drawing Figures

IMPROVEMENTS IN AND RELATING TO FANS

This invention relates to a ventilating fan of the kind comprising an open-ended casing for mounting in a throughopening in a window, wall, roof, partition or the like of a space to be ventilated, a housing located within the casing, and an impeller rotatable from an electric motor or other prime mover within the housing.

Frequently this kind of fan is fitted with a shutter device by means of which the air-passage through the fan housing can be closed when the impeller is at rest. It is known to control the shutter device by means responsive to the rotating speed of the impeller or electrical supply to the prime mover and thus to obtain a measure of automatic control whereby the shutter opens as the fan is turned on and closes as it is turned off.

This invention relates to an improved construction of ventilating fan having an improved automatic shutter device.

According to the present invention there is provided an axial fan comprising a housing defining an air passage, a prime mover for rotating a shaft that is rotatable co-axially within the housing, said shaft being adapted to drive an air impeller, shutter means consisting of shutter plates which may have their pivot axes tangential to a common circle having a radius $r_1$ and having its center substantially coincident with the axis of said shaft and in a plane substantially normal to the axis of said shaft, said shutter plates being movable by shutter operating means responsive to rotation of the shaft to move the shutter means to a position that opens said air passage when the impeller is rotating and to a position that closes said air passage when the impeller is not rotating. The shutter operating means may be such that substantially no thrust or load is placed upon the prime mover when it is rotating at a selected operating speed.

Conveniently the air passage is of annular form and a plurality of shutter plates pivoted about axes tangential to a circle concentric with the passage are employed.

In one embodiment a shuttle is adapted to operate a movable shutter means the shuttle being keyed for sliding motion axially of the shaft. The shutter means is conveniently a plate biased to a position in which the shutter plate closes the air passage. Bob-weights may be provided to rotate with the shaft and to move outwardly under centrifugal force during such rotation and cause the shutter plate or plates to move against a spring bias and bring the shutter means to the position that opens said air passage.

A particular embodiment of the invention will now be described by way of example only, with reference to the figures of the accompanying drawings in which.

Figure 1:
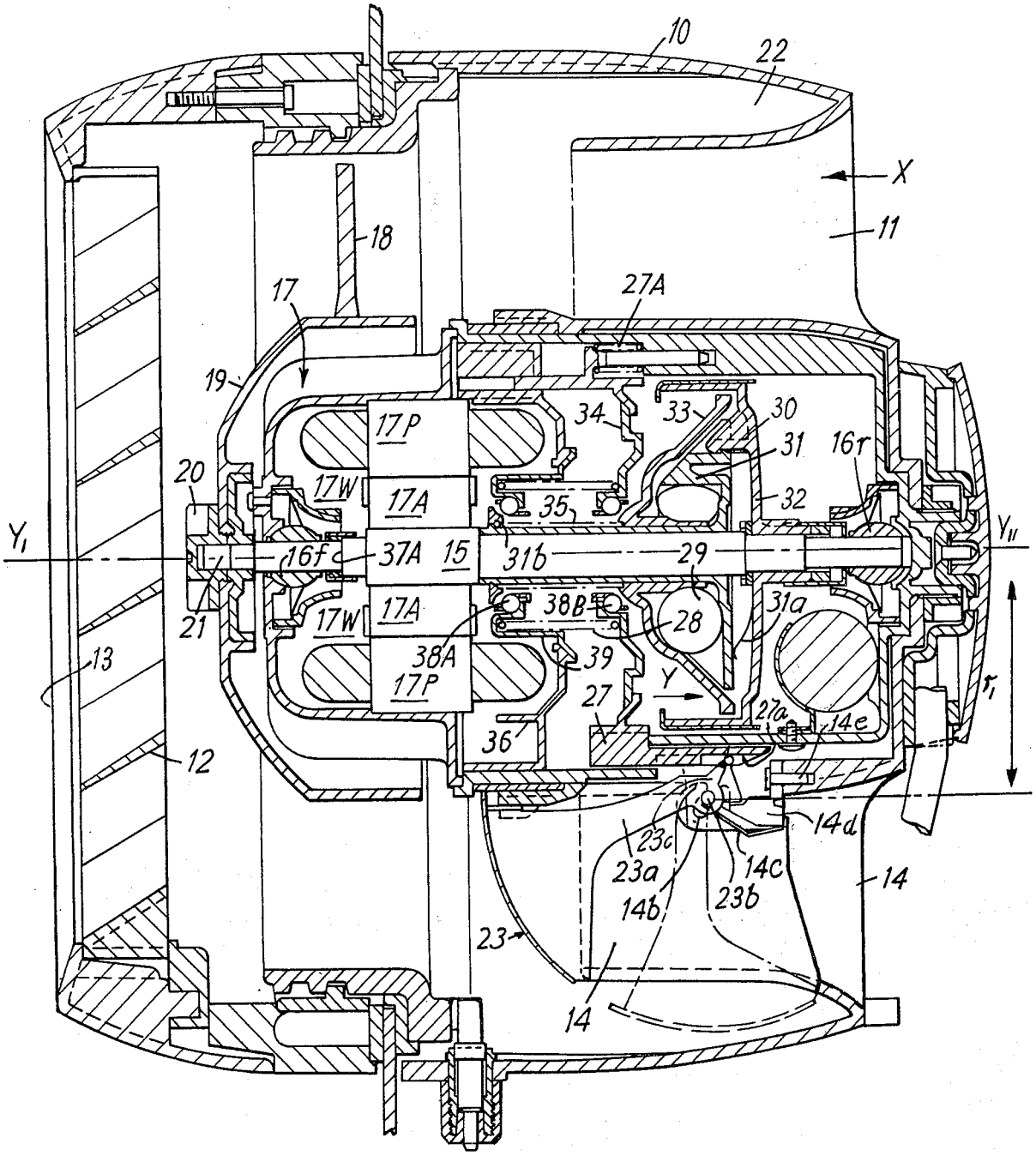
FIG. 1 is a sectional elevation diametrically through an axial extractor fan.

The axial fan assembly illustrated in FIG. 1 of the drawing comprises an housing 10 of generally cylindrical form defining an air passage 11. A slatted grid 12 (which aids in keeping rain out of the housing while allowing air to flow outwardly or inwardly therefrom) is secured across the outlet of the housing by an annular mounting assembly 13. The specific constructions of the housing 10 or outer casing and the manner in which it is incorporated into a support structure for the fan form no part of the present invention and will not be described in further detail since it is well understood, (see for example our United Kingdom Patent Specification 910,475). A drive assembly shown generally at 17 is coaxially placed within the air passage 11 and is supported by radially extending struts 14 (four in the embodiment illustrated, but only one is shown).

A driven shaft 15 journalled in front and rear bearings $\mathbf{16}_f$, $\mathbf{16}_r$ is coaxially disposed within the said drive assembly 17 and includes a rotor of an electric motor. A plurality of fan blades 18 extend radially outwardly from a boss 19 fast on the shaft 15, the said blades being integrally formed with the boss. The electric motor and the fan blades are well known and their construction forms no part of the present invention.

Figure 2:
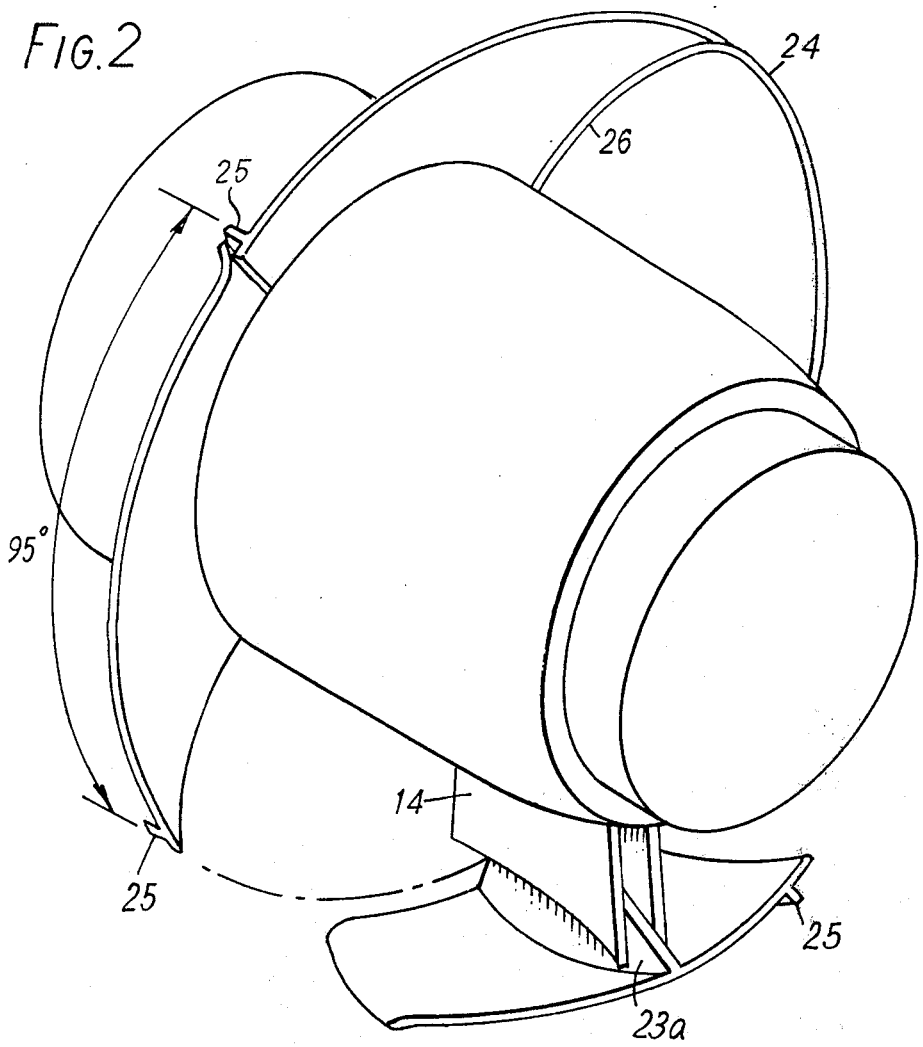
FIG. 2 is a view in perspective of shutter means with part of the casing removed.

The boss 19 is fixed to the driven shaft 15 by means of a lock nut 20 and is made a complementary fit with an end 21 of D-section. The driven shaft 15 is driven by means of the electric motor, said shaft being fixed to an armature $\mathbf{17}_A$ defining the rotor and located within a stator comprising pole pieces $\mathbf{17}_p$ provided with pole winding $\mathbf{17}_W$. The housing 10 has towards its end furthest from the fan blades 18 an annular cavity 22 into which a shutter means comprising four arcuate shutter plates 23 (one only is shown) may move to take up the open position (dotted lines) and out of which it may move to take up the closed position (full lines). In the closed position of the shutter means the shutter plates 23 are each closer in towards the axis $Y_1Y_{11}$ of the shaft 15 than they are when they reside in the open position. In their closed positions the shutter plates 23 substantially completely close the annular air passage 11. Each shutter plate 23 extends in a circumferential direction to cover, in this example, a little over one fourth of the cross-sectional area of the annular air passage and hence subtends at the centre of the shaft 15 an angle of about 95° of arc (FIG. 2). To provide a small area of overlap 24 at their radial edges, each shutter plate 23 is provided with an abutment ridge 25 adjacent to one radially directed edge, which ridge abuts with the radial edge 26 of the plate that adjoins it. Each shutter plate 23 has an arm 23*a* that moves in a groove in one of the radial struts 14 (see FIG. 2), each arm 23*a* terminating at 23*b* in a bell crank lever 23*c* which engages in a recess in a shuttle sleeve 27 that is spring urged by a powerful helical extension return spring 28 to move it to the right in the direction of arrow Y, and hence to move the shutter plates 23 towards their closed positions. The shutter plates 23 are moved to the open position by the forces produced by a plurality of springs 27*a* acting on the shuttle sleeve 27 in the direction of arrow X, said shuttle sleeve 27 moving in this direction only when the disc 34 is moved to the left. The disc 34 is moved against the force of the spring 28 by axial forces acting on it also in the direction of arrow X, said axial forces being caused by centrifugal forces generated by a plurality of bob-weights 29. From an examination of FIG. 1 it will be appreciated that the movement of each shutter plate between its closed and opened positions is not a pivoting about a fixed axis but rather a pivoting about an axis which can move backwards and forwards in a slot 14*b* in a member 14*d* secured by a screw 14*e* to strut 14 and under the influence of a leaf spring 14*c*. The translation of the axis in the slot 14*b* allows a more positive movement of each shutter plate to take place since intermediate the closed and opened positions the axis passes "over-center".

The bob-weights 29 are constrained against circumferential movement relative to a vane plate 31, but are free to move in the radial direction within recesses in the vane plate 31. The vane plate 31 is integral with a tube slidably located around the shaft 15 and is urged to the left in FIG. 1 by a relatively strong drive spring 31*a*. The vane plate 31 is driven in synchronism with the shaft 15 by a cup 32 keyed to the shaft 15, pegs 30 on the cup 32 engaging in recesses in the plate 31.

The bob-weights 29 move inward and outward of the axis of the drive shaft 15 as the cup 32 (and thus the vane plate 31) decelerates and accelerates, respectively. When the bob-weights 29 move outward by rotation of the vane plate 31 within the cup 32, a cone 33 (slidably disposed on the tube of the plate 31) moves axially to the left as shown in FIG. 1, in the direction of the arrow X, until the cone 33 abuts with a ball race $38_B$ on a disc 34. The disc 34 is in contact with the shuttle sleeve 27 and can rotate relative thereto. As the disc 34 is moved to the left, it allows the shuttle sleeve 27 also to move to the left urged by springs 27*a* until it eventually bears against a stop 36. Further movement of the cone 33 to the left releases the disc 34 from engagement with the sleeve 27 and shortly thereafter the outer periphery of the cone 33 engages the left-hand lip of the cup 32. At this point, although the bob-weights are close to their radial outer limiting position on the vane plate 31 they are not in that limiting position, and as they move outwardly the final amount to reach that limiting position, they force the vane plate 31 to the right against the urging of the spring 31*a*. A race 31*b* on the tube section of vane plate 31 is thus also moved to the right and by an amount sufficient to engage a ball race 38A on a cap 39 heretofore resting against the stop 36. As the cap 39 is lifted free of the stop 36 the shutter actuating mechanism is divided into a part fast with the shaft 15 (the cup 32, the vane plate 31 and the cone 30), a non-rotatable part (the stop 36 and the shuttle sleeve 27) and a released intermediate part (the disc 34 and the cap 39) between the ball race 38A and a ball race 38B.

The six bob-weights in their radially outer position have a fly wheel effect on the shaft 15 (stabilizing it against sharp changes in rotational speed) and the released intermediate part ensures that at operating speed substantially no thrust or load is placed on the motor 17 by the shutter operating mechanism. In turn this means that although energy is absorbed by the shutter operating mechanism during acceleration, before operating speed is reached, the release described above takes place, and thereafter during that operating period, the motor power is substantially all available for rotating the impeller.

When an operating period is concluding, and the impeller is decelerating, the deceleration first includes a phase in which the bob-weights move in from their radially outermost position adjacent to the cylindrical wall of the cup 32 and this causes the vane plate 31 to move to the left (urged by the spring 31*A*), to re-engage the cap 39 with the stop 36. Further deceleration causes the bob-weights to move inwardly still more (under the influence of the springs 35 and 28) until the disc 34 re-engages with the shuttle sleeve 27 and both these move to the right. The shutter plates now pivot back towards their closed position and, in a preferred embodiment of fan in accordance with the invention, have reached their closed position just prior to the impeller ceasing its rotation.

Figure 3:
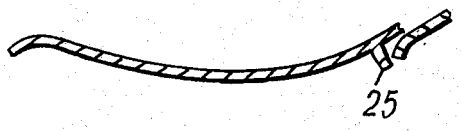
FIG. 3 is a diagrammatic representation of the overlap of two blades of the shutter means.

FIG. 3 shows the edge-on form of a shutter plate 23 and the area of overlap or sealing which ensures that when the plates are closed the total circumferential area of the air passageway is itself fully closed without any interstitial gaps.

I claim:

1. An axial fan comprising a housing with a drive assembly positioned therein to define therewith an annular air passage, said drive assembly including a shaft co-axially arranged with respect to said air passage and a prime mover for rotating said shaft, said shaft being adapted to drive an air impeller, shutter means positioned within said air passage an carried by said drive assembly for pivotal movement with respect thereto, said shutter means including shutter plates having their pivotal axis tangential to a common circle lying in a plane substantially normal to the axis of said shaft with said circle having its center substantially coincident with the axis of said shaft, said shutter plates being movable by shutter operating means responsive to rotation of the shaft to move the shutter means to a position that opens said air passage when the impeller is rotating and to a position that closes said air passage when the impeller is not rotating.

2. An axial fan as defined in claim 1 wherein said open position of said air passage is obtained by said shutter plates moving toward the periphery of said housing and away from said shaft.

3. An axial fan as set forth in claim 1 wherein each of said shutter plates is provided with a bell crank lever at the pivotal axis, said bell crank lever cooperating with a shuttle sleeve that slides axially of said shaft in response to a force produced by one or more springs opposed by centrifugal force produced by bob weights driven by said shaft.

4. An axial fan as set forth in claim 3 wherein each shutter plate is provided with a pivot that is able to pass over dead center intermediate the said closed and opened positions.

* * * * *